US008931390B2

(12) United States Patent
Bird

(10) Patent No.: US 8,931,390 B2
(45) Date of Patent: Jan. 13, 2015

(54) BALLISTIC PROTECTION MATERIAL

(71) Applicant: Sikorsky Aircraft Corporation, Stratford, CT (US)

(72) Inventor: Connie E. Bird, Rocky Hill, CT (US)

(73) Assignee: Sikorsky Aircraft Corporation, Stratford, CT (US)

( * ) Notice: Subject to any disclaimer, the term of this patent is extended or adjusted under 35 U.S.C. 154(b) by 0 days.

(21) Appl. No.: 13/778,620

(22) Filed: Feb. 27, 2013

(65) Prior Publication Data

US 2014/0238224 A1 Aug. 28, 2014

(51) Int. Cl.
*F41H 7/04* (2006.01)
*F41H 5/04* (2006.01)

(52) U.S. Cl.
CPC .. *F41H 7/04* (2013.01); *F41H 5/04* (2013.01); *F41H 5/0442* (2013.01); *F41H 5/0471* (2013.01)
USPC ..... 89/36.02; 89/912

(58) Field of Classification Search
USPC ..... 89/36.02, 36.04, 36.07, 36.08, 36.09, 89/36.17; 428/911
See application file for complete search history.

(56) References Cited

U.S. PATENT DOCUMENTS

| | | | | |
|---|---|---|---|---|
| 333,780 | A | 1/1886 | Pederson | |
| 3,729,809 | A | 5/1973 | Vawter et al. | |
| 5,332,349 | A | 7/1994 | Gerwin | |
| 5,685,058 | A | 11/1997 | Givler | |
| 6,295,710 | B1 | 10/2001 | Roberts et al. | |
| 2006/0213361 | A1 * | 9/2006 | Muller et al. | 89/36.02 |
| 2008/0012169 | A1 * | 1/2008 | Solomon et al. | 264/136 |
| 2011/0168001 | A1 * | 7/2011 | Lee | 89/36.02 |
| 2011/0192274 | A1 * | 8/2011 | Fingerhut | 89/36.02 |
| 2011/0296979 | A1 * | 12/2011 | Howland | 89/36.02 |
| 2012/0174759 | A1 * | 7/2012 | Gallo et al. | 89/36.02 |

* cited by examiner

*Primary Examiner* — Bret Hayes
(74) *Attorney, Agent, or Firm* — Carlson, Gaskey & Olds

(57) ABSTRACT

According to an embodiment, a ballistic protection material includes a strike face layer having a first thickness. The strike face layer is configured to distort an outer surface on a projectile that contacts the strike face layer. A ballistic layer is configured to hinder continued movement of a projectile that has passed through the strike face layer. A spacer layer is situated between the strike face layer and the ballistic layer. The spacer layer has a second thickness that is greater than the first thickness. The second thickness of the spacer layer provides a selected distance between the strike face layer and the ballistic layer.

22 Claims, 3 Drawing Sheets

BALLISTIC PROTECTION MATERIAL

BACKGROUND

There are a variety of uses for ballistic protection materials. For example, personal armor, such as a bullet proof vest, is useful for protecting individuals. Some ballistic protection materials have been incorporated into vehicles, such as military aircraft, ships or land vehicles. One aspect of most ballistic protection materials used for vehicle applications is that they are added on the vehicle to supplement the structural materials of the vehicle. While this approach is valuable in that it provides protection for occupants and vehicle components it has the potential drawback of adding weight and expense.

Some ballistic protection materials that have been proposed for vehicles are limited to a flat, planar configuration. This limits the manner in which the material may be incorporated into components that have some curvature or another shape.

Another aspect of some ballistic protection materials is that they are designed for a specific purpose or to protect against an attack that involves a particular type of ammunition. It therefore may not be possible to utilize one type of ballistic protection material intended for one application in a different context.

SUMMARY

According to an embodiment, a ballistic protection material includes a strike face layer having a first thickness. The strike face layer is configured to distort an outer surface on a projectile that contacts the strike face layer. A ballistic layer is configured to hinder continued movement of a projectile that has passed through the strike face layer. A spacer layer is situated between the strike face layer and the ballistic layer. The spacer layer has a second thickness that is greater than the first thickness. The second thickness of the spacer layer provides a selected distance between the strike face layer and the ballistic layer.

Various features and advantages of at least one disclosed example embodiment will become apparent to those skilled in the art from the following detailed description. The drawings that accompany the detailed description can be briefly described as follows.

DETAILED DESCRIPTION

Figure 1:
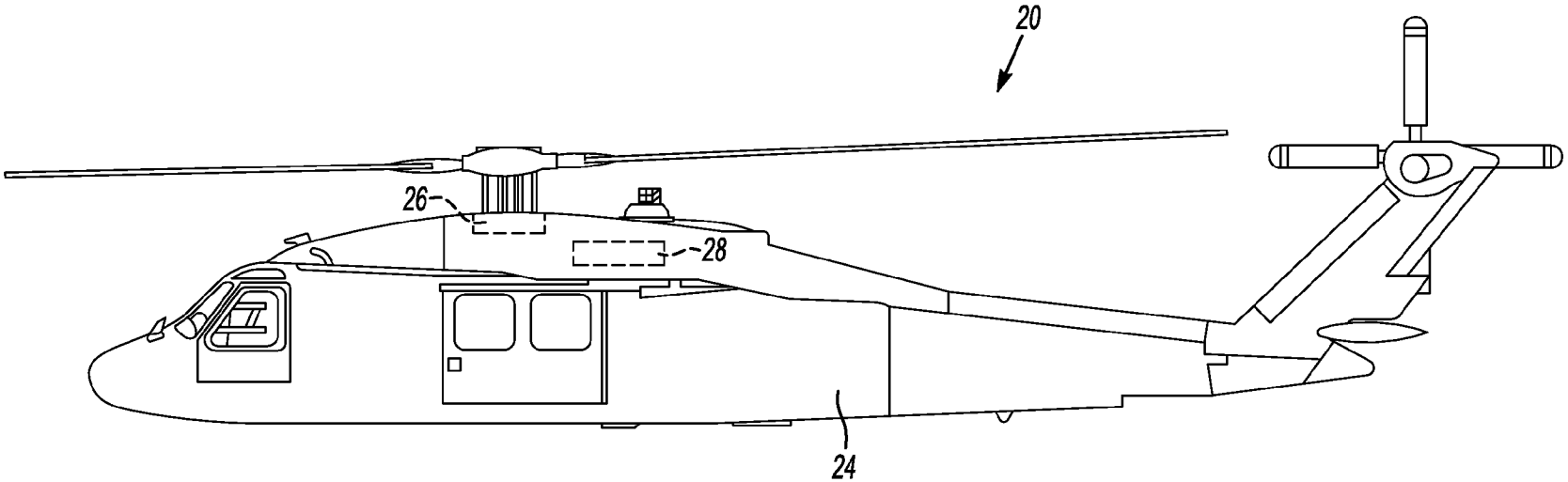
FIG. 1 schematically illustrates an example vehicle including at least one ballistic protection body panel designed according to an example embodiment.

FIG. 1 illustrates an example vehicle 20. In this example, the vehicle 20 is an aircraft. In particular, the vehicle 20 is a rotary wing aircraft or helicopter. One possible use of the aircraft 20 is transporting military personnel.

The vehicle 20 includes an exterior body 24. The vehicle 20 includes various operational components such as drive components schematically shown at 26 and fuel supply components schematically shown at 28. The disclosed example ballistic materials are useful for protecting such components from ballistic attack. One of the features of the ballistic protection materials of this description is that they are formable to have a non-planar configuration over at least a portion of the surface area of a ballistic protection panel. In some instances, the entire panel comprising the ballistic protection material has a non-planar configuration or contour.

Figure 2:
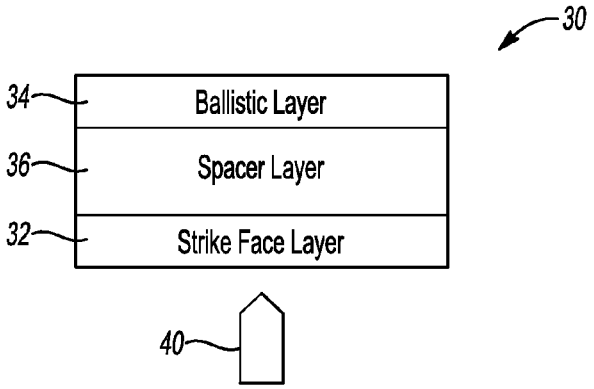
FIG. 2 schematically illustrates an example ballistic protection material composition according to an example embodiment.

FIG. 2 schematically illustrates the composition of an example ballistic protection material 30. This example includes a strike face layer 32, a ballistic layer 34 and a spacer layer 36 between the strike face layer 32 and the ballistic layer 34.

In one example, the strike face layer 32 comprises a rigid material that is shapeable. Example materials for some embodiments of the strike face layer 32 include aluminum, steel, titanium and a carbon composite. Titanium is useful in situations where it is desirable that the strike face layer 32 have a high yield strength and ductility. Titanium, for example, tends to deform out of plane and tears in a cross-shape configuration, which is sometimes referred to as petalling. These features are useful to facilitate distorting or tearing a shell from a leading edge of a projectile 40.

In some examples, the strike face layer 32 includes a plurality of holes or openings through the strike face layer 32. In some examples, the strike face layer comprises at least one of a mesh, a lattice, a screen or a weave. Such a configuration of the strike face layer 32 enhances the ability of the strike face layer 32 to distort at least an outer shell or casing on the projectile 40.

The spacer layer 36 in some examples comprises a rigid foam. Polystyrene foam, for example, is used in some embodiments.

The ballistic layer 34 in some examples comprises an ultra-high-molecular-weight polyethylene. Some example ballistic layers 34 include DYNEEMA®, which is a commercially available material.

Each of the layers 32, 34 and 36 is rigid and shapeable so that the ballistic protection material 30 can be configured as a non-planar body panel having a desired shape or contour. One aspect of being able to shape the ballistic protection material in this manner is that it reduces seams along the exterior of a vehicle, which may maximize protection. Reducing the number of seams required reduces interfaces between different panels where the level of protection may be reduced compared to a center portion of a panel, for example. Additionally, having a continuous body panel may reduce the amount of overlap that otherwise would be provided along seams between multiple smaller panels in an attempt to enhance protection along the seams. Reducing an amount of overlap may reduce the amount of material required, which provides cost savings and reduces the weight of the vehicle.

In some examples, the ballistic protection material 30 is configured to defend against projectiles including ball round projectiles or ball round ammunition such as 7.62 mm×39 M1943 ball PS ammunition offloaded to a 100 m standoff velocity of 1950 ft/sec (595 m/sec). The areal density of one example ballistic protection material 30 designed to defend against such ammunition is 4.0 lbs/ft$^2$ (191.5 N/m$^2$).

In one example, the strike face layer 32, spacer layer 36 and ballistic layer 34 are bonded together using an adhesive that is suitable for the materials selected for each layer.

As can be appreciated from the drawing, the strike face layer 32 has a first thickness and the spacer layer 36 has a second, greater thickness. The second thickness of the spacer layer 36 provides a desired distance or spacing between the strike face layer 32 and the ballistic layer 34. The spacing provided by the spacer layer 36 allows for any distortion of or change in direction of the projectile 40 caused by the strike face layer 32 to proceed over a greater distance and during a longer period of time before the projectile 40 reaches the ballistic layer 34.

For example, the strike face layer 32 is configured to at least partially distort an outer shell of the projectile 40 as the projectile 40 contacts the strike face layer 32. The strike face layer 32 may also be configured to at least partially strip an outer shell or jacket from the projectile 40. In many instances, the strike face layer 32 is also configured to alter a direction of movement of the projectile 40. As the projectile 40 moves through the spacer layer 36, the amount of distortion, which is initiated by the strike face layer 32, may increase before the projectile 40 reaches the ballistic layer 34. This allows for additional blunting of a leading edge of the projectile 40 before it reaches the ballistic layer 34. Any tipping of the projectile 40 or change in its direction of movement initiated by the strike face layer 32 continues through the spacer layer 36, which has the effect of further changing an angle at which the projectile 40 contacts the ballistic layer 34. Allowing for increased blunting and further changes in the direction of movement of the projectile 40 enhances the ability of the ballistic layer 34 to prevent the projectile 40 from passing through the ballistic layer 34.

Figure 3:
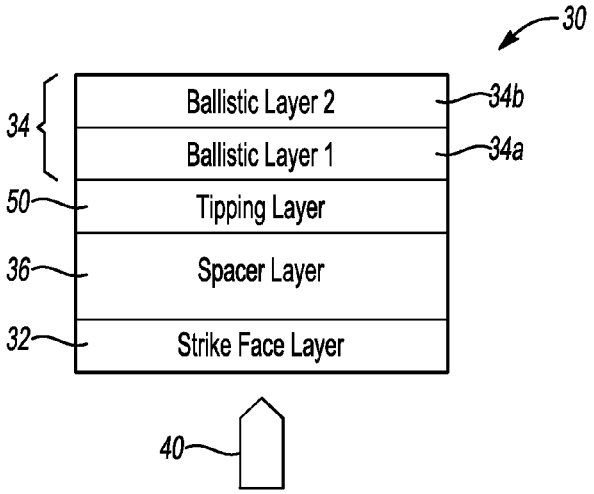
FIG. 3 schematically illustrates another example embodiment of a ballistic protection material composition.

FIG. 3 schematically illustrates an example ballistic protection material composition including a strike face layer 32, ballistic layer 34 and spacer layer 36. This example also includes a tipping layer 50 between the spacer layer 36 and the ballistic layer 34. The tipping layer 50 is configured to change a direction of movement of the projectile 40 before the projectile 40 contacts the ballistic layer 34. For example, if the strike face layer 32 tips the projectile 40, after the projectile 40 passes through the spacer layer 36, the tipping layer 50 further tips the projectile 40 to increase the likelihood that the projectile 40 contacts the ballistic layer 34 at an oblique angle. Increasing an amount of a side portion, as opposed to a leading edge, of the projectile 40 that contacts the ballistic layer 34 increases the likelihood that the ballistic layer 34 will prevent the projectile 40 from penetrating through the ballistic layer 34.

In the example of FIG. 3, the ballistic layer 34 includes a first layer 34*a* and a second layer 34*b*. In some examples, the first layer 34*a* comprises a first ultra-high-molecular-weight polyethylene and the second layer 34*b* comprises a second, different ultra-high-molecular-weight polyethylene.

In one embodiment of a ballistic protection material 30 consistent with the arrangement shown in FIG. 3, the strike face layer 32 comprises a titanium woven cloth, the spacer layer 36 comprises a lightweight rigid foam, the tipping layer 50 comprises a titanium woven cloth, the ballistic layer 34*a* comprises DYNEEMA® HB80 and the ballistic layer 34*b* comprises DYNEEMA® HB50.

Figure 4:
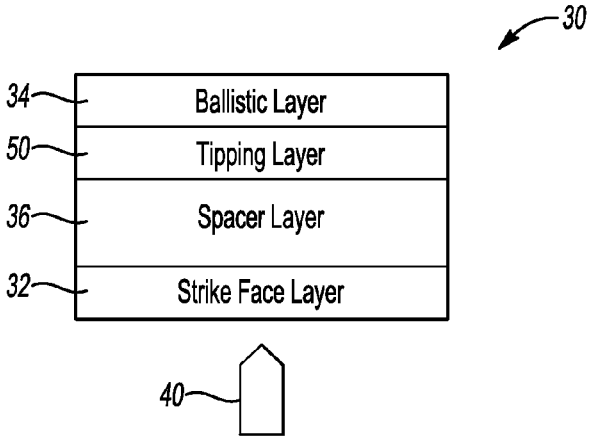
FIG. 4 schematically illustrates another example embodiment of a ballistic protection material composition.

FIG. 4 schematically illustrates another ballistic protection material composition that includes a tipping layer 50. This example includes a single ballistic material for the ballistic layer 34. In one embodiment configured in the manner shown in FIG. 4, the strike face layer 32 comprises a carbon composite, the spacer layer 36 comprises a rigid lightweight foam, the tipping layer 50 comprises a titanium sheet and the ballistic layer 34 comprises DYNEEMA® HB50.

While different configurations and different material selections are described above in connection with individual embodiments, it is possible to combine one or more features of one or more of the embodiments into another embodiment. Additionally, it is possible to separate one of the layers into multiple, distinct layers. For example, one embodiment includes a portion of the spacer layer 36 between the strike face layer 32 and one ballistic layer 34 with another portion of the spacer layer 36 between that ballistic layer and a second ballistic layer.

Figure 5:
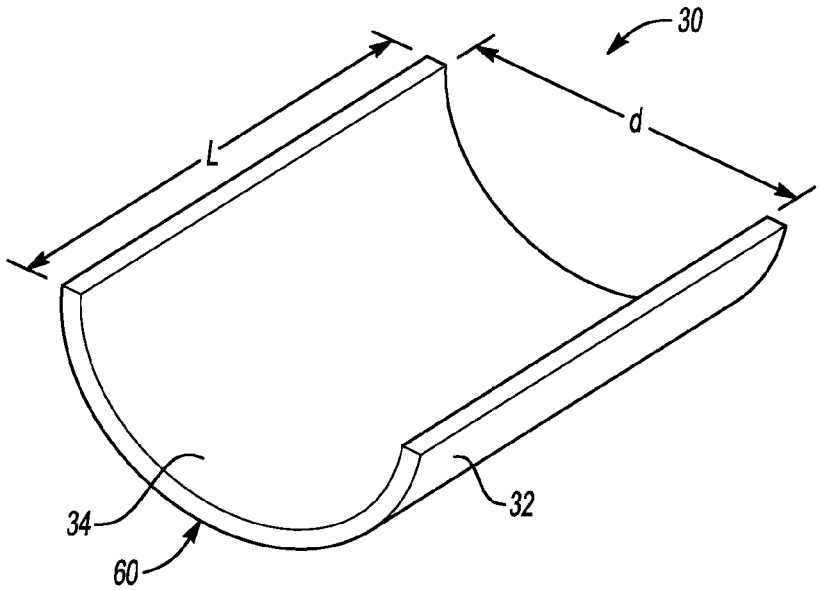
FIG. 5 illustrates an example ballistic material configuration according to an embodiment.
Figure 6:
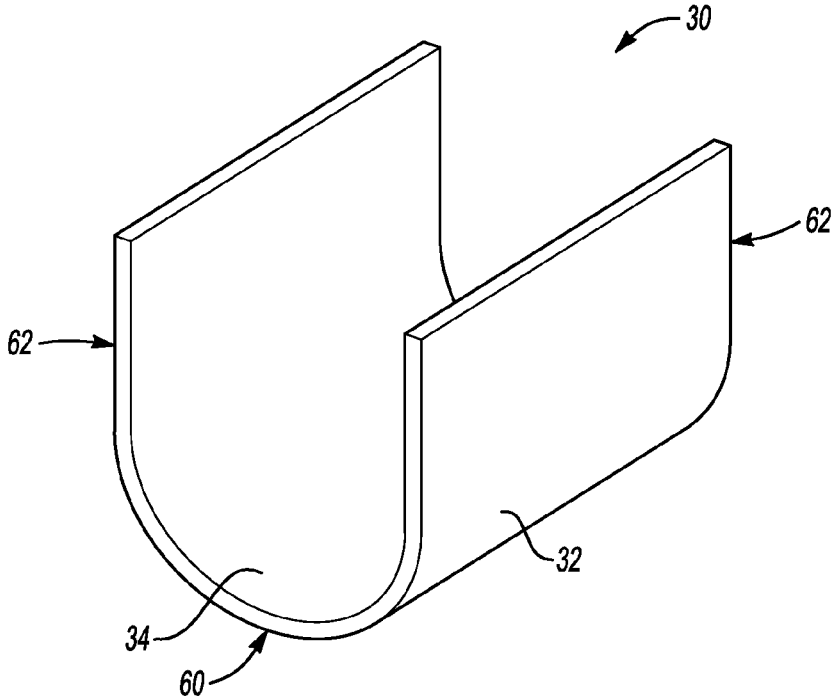
FIG. 6 illustrates another example ballistic material configuration according to an embodiment.

FIG. 5 illustrates an example panel contour that is included in one embodiment. In this example, the panel 30 has a length l and an inside diameter dimension d that establishes or defines an arched portion 60. FIG. 6 illustrates another example panel configuration that includes an arched portion 60 and relatively flat sections 62 extending from opposite edges of the arched portion 60. The curvature of the examples of FIGS. 5 and 6 is significant compared to a flat or even slightly non-planar panel. As can be appreciated from the illustrations, the radius (i.e., d/2) is arched over about 180°. The panel of FIG. 5 can be considered a half-cylinder and is well-suited for at least partially covering over a selected component within tight space constraints. The example panels 30 provide seamless protection across the surface of each panel.

In some examples, the length l is approximately three times the dimension d. For example, the inside diameter d is approximately 6 inches (15 cm) and the length l is approximately 18 inches (45 cm). Some examples include even smaller inside diameter dimensions, d.

The disclosed examples provide a ballistic protection material that is useful for establishing rigid panels or components having a non-planar contour or configuration along at least a portion of the surface area of the body panel. The example ballistic protection materials are configured to defend against ball round ammunition for a variety of types of vehicle components including, but not limited to, aircraft components.

The preceding description is illustrative rather than limiting in nature. Variations and modifications to the disclosed examples may become apparent to those skilled in the art. The scope of legal protection can only be determined by studying the following claims.

I claim:

1. A ballistic protection material, comprising:

a strike face layer having a first thickness, the strike face layer comprising a titanium woven cloth, the strike face layer being configured to distort an outer surface on a ball round projectile;

a ballistic layer configured to hinder continued movement of a ball round projectile that has passed through the strike face layer; and a spacer layer situated between the strike face layer and the ballistic layer, the spacer layer having a second thickness that is greater than the first thickness, the second thickness of the spacer layer being configured to provide a selected distance between the strike face layer and the ballistic layer.

2. The ballistic protection material of claim 1, wherein each of the strike face layer, the ballistic layer and the spacer layer is rigid.

3. The ballistic protection material of claim 1, wherein the material has a non-planar contour over at least a portion of a surface area of the material.

4. The ballistic protection material of claim 1, wherein the strike face layer comprises at least one of aluminum, steel, or a carbon composite.

5. The ballistic protection material of claim 4, wherein the strike face layer includes a plurality of openings through the strike face layer.

6. The ballistic protection material of claim 5, wherein the strike face layer comprises at least one of a mesh, a lattice, or a screen.

7. The ballistic protection material of claim 1, wherein the strike face layer is configured to change a direction of travel of a projectile that contacts the strike face layer.

8. The ballistic protection material of claim 1, wherein the spacer layer comprises rigid foam.

9. The ballistic protection material of claim 1, wherein the ballistic layer comprises ultra-high-molecular-weight polyethylene.

10. The ballistic protection material of claim 1, wherein the strike face layer is configured to at least partially strip a jacket from the ball round projectile and the ballistic layer is configured to prevent the ball round projectile from passing through the ballistic layer.

11. The ballistic protection material of claim 1, wherein the spacer layer comprises a rigid foam; and the ballistic layer comprises a layer of a first ultra-high-molecular-weight polyethylene and a layer of a second ultra-high-molecular-weight polyethylene.

12. The ballistic protection material of claim 11, comprising a tipping layer between the rigid foam and the first ultra-high-molecular-weight polyethylene, the tipping layer being configured to alter a direction of travel of a projectile that contacts the tipping layer.

13. The ballistic protection material of claim 12, wherein the tipping layer comprises a woven cloth comprising titanium.

14. The ballistic protection material of claim 1, wherein the strike face layer comprises a carbon composite;

the spacer layer comprises a rigid foam; and the ballistic layer comprises an ultra-high-molecular-weight polyethylene.

15. The ballistic protection material of claim 14, comprising a tipping layer between the rigid foam and the ultra-high-molecular-weight polyethylene, the tipping layer being configured to alter a direction of travel of a projectile that contacts the tipping layer.

16. The ballistic protection material of claim 1, wherein the ballistic protection material has an areal density of approximately 4.0 lbs/ft$^2$ (191.5 N/m$^2$).

17. A vehicle, comprising:

at least one operational component; and at least one ballistic protection panel situated near the operational component, the ballistic protection panel having a non-planar contour, the ballistic protection panel comprising:

a strike face layer having a first thickness, the strike face layer comprising a titanium woven cloth, the strike face layer being configured to distort an outer surface on a ball round projectile;

a ballistic layer configured to hinder continued movement of a ball round projectile that has passed through the strike face layer; and a spacer layer situated between the strike face layer and the ballistic layer, the spacer layer having a second thickness that is greater than the first thickness, the second thickness of the spacer layer being configured to provide a selected distance between the strike face layer and the ballistic layer.

18. The vehicle of claim 17, wherein the strike face layer comprises at least one of aluminum, steel, or a carbon composite; and includes a plurality of openings through the strike face layer.

19. The vehicle of claim 17, wherein the spacer layer comprises rigid foam.

20. The vehicle of claim 17, wherein the ballistic layer comprises ultra-high-molecular-weight polyethylene.

21. The vehicle of claim 17, wherein the strike face layer is configured to at least partially strip a jacket from the ball round projectile and the ballistic layer is configured to prevent the ball round projectile from passing through the ballistic layer.

22. The ballistic protection material of claim 17, wherein the ballistic protection panel has an areal density of approximately 4.0 lbs/ft$^2$ (191.5 N/m$^2$).

* * * * *